US006494431B1

(12) United States Patent
McCoy

(10) Patent No.: US 6,494,431 B1
(45) Date of Patent: Dec. 17, 2002

(54) SUPPORT BRACKET FOR AN OUTBOARD MOTOR

(75) Inventor: David F. McCoy, Rosendale, WI (US)

(73) Assignee: Brunswick Corporation, Lake Forest, IL (US)

( * ) Notice: Subject to any disclaimer, the term of this patent is extended or adjusted under 35 U.S.C. 154(b) by 47 days.

(21) Appl. No.: 09/777,590

(22) Filed: Feb. 6, 2001

(51) Int. Cl.[7] ..... F16M 1/00; F16M 3/00; F16M 5/00; F16M 9/00; F16M 11/00

(52) U.S. Cl. ..... 248/640

(58) Field of Search ..... 248/640, 641, 248/642, 643, 292.13; 114/440.55, 900

(56) References Cited

U.S. PATENT DOCUMENTS

| | | | | | |
|---|---|---|---|---|---|
| 2,179,357 | A | * | 11/1939 | Stava | 111/939 |
| 3,505,971 | A | * | 4/1970 | Dalke | 115/34 |
| 3,785,328 | A | | 1/1974 | Kloiber | 115/17 |
| 4,013,249 | A | * | 3/1977 | Meyer | 248/4 |
| 4,052,952 | A | * | 10/1977 | Hale | 115/41 |
| 4,331,430 | A | | 5/1982 | Lutzke et al. | 440/53 |
| 4,367,860 | A | * | 1/1983 | Strang | 248/641 |
| 4,472,148 | A | | 9/1984 | Kollock et al. | 440/53 |
| 4,826,459 | A | | 5/1989 | Slattery | 440/55 |
| 4,872,859 | A | * | 10/1989 | Griffiths | 440/53 |
| 4,925,410 | A | | 5/1990 | Boda | 440/55 |
| 5,006,083 | A | * | 4/1991 | Sumigawa | 440/61 |
| 5,188,548 | A | * | 2/1993 | Ferguson | 440/61 |
| 5,382,183 | A | * | 1/1995 | Rompre | 440/59 |
| 5,389,017 | A | * | 2/1995 | Huzjak | 440/53 |
| 5,855,496 | A | | 1/1999 | Lokken | 440/53 |
| 5,868,591 | A | | 2/1999 | Kleeman et al. | 440/53 |

* cited by examiner

*Primary Examiner*—Ramon O. Ramirez
*Assistant Examiner*—Amy J. Sterling
(74) *Attorney, Agent, or Firm*—William D. Lanyi

(57) ABSTRACT

A support bracket for an outboard motor is provided in which a support arm is pivotally attached to a transom bracket of an outboard motor to allow it to pivot upward and be captured by a latching device which is rigidly attached either to a support structure. of the outboard motor or directly to its driveshaft housing. When captured within the latching device attached to the outboard motor, the support arm prevents upward or downward movement of the outboard motor and inhibits any rotation of the outboard motor about its tilt axis. The support arm also inhibits rotation of the outboard motor about its steering axis. The support mechanism therefore prevents potential damage to the outboard motor and its support brackets when the outboard motor is stored in an upwardly tilted position and subjected to shock loads.

20 Claims, 3 Drawing Sheets

SUPPORT BRACKET FOR AN OUTBOARD MOTOR

BACKGROUND OF THE INVENTION

1. Field of the Invention

The present invention is generally related to a support bracket for an outboard motor and, more particularly, to a support bracket that prevents the outboard motor from moving upward and downward relative to an upward trim position and also prevents the outboard motor from moving rotatably about its steering axis when in an upwardly trimmed position.

2. Description of the Prior Art

It is well known to those skilled in that art that outboard motors can be raised to an upward trim position and maintained in that position for relatively long periods of time. For example, when transporting a marine vessel, it is common to move the outboard motor to an upwardly tilted position during the transporting of the boat on a trailer towed by an automobile. In addition, it is common to raise the outboard motor to an upwardly tilted position relative to the transom of a boat during the use of the boat, particularly when the outboard motor is a spare outboard motor, or "kicker" motor. If the marine vessel is subjected to shock loads, such as during movement of the boat over waves or rough water, the upward position of a tilted outboard motor can subject the support structure of the outboard motor to severe stresses. As a result, the transom bracket of the outboard motor can be subjected to stress that is sufficient to cause fracture of the bracket. When this occurs, it is possible for the outboard motor to be disconnected from the transom of a boat and be lost overboard.

Those skilled in the art of outboard motor manufacture and use are familiar with many different types of locking mechanisms used in conjunction with outboard motors to hold the motor in a preselected position, such as an upwardly tilted position used during transportation of the boat.

U.S. Pat. No. 3,785,328, which issued to Kloiber on Jan. 15, 1974, discloses an outboard motor anti-tilt locking mechanism which incorporates locking fingers that are actuated by a flexible shaft driven by a channel cam keyed to the shift shaft of the engine. A readily disassemblable ball joint links the flexible operating shaft to a rotating mechanism carrying the locking fingers.

U.S. Pat. No. 5,868,591, which issued to Kleeman et al on Feb. 9, 1999, discloses a swivel lock for an outboard motor. First and second latch mechanisms are provided that allow a boat operator to prevent the movable and stationary portions of an outboard motor from moving relative to each other. This device can be used during shipping, transportation, or use of an outboard motor in conjunction with a sailboat in which the rudder of the sailboat is used for steering, and it is desirable to maintain the movable and stationary portions of an outboard motor rigidly with respect to each other. A first latch mechanism is attached to the movable portion of the outboard motor and a second latch mechanism is attached to the stationary portion of the outboard motor. The second latch mechanism is rotatable to place a receptacle into a region where a locking device can retain it.

U.S. Pat. No. 4,826,459, which issued to Slattery on May 2, 1989, discloses a tilt mechanism for an outboard motor. The mechanism includes a series of trim and shallow water operation positions which may be preset by the operator and from which the motor may be temporarily tilted up without engaging and being held in a higher tilt position. Correspondingly, elimination of the condition requiring or causing the temporary tilt-up allows direct return of the motor to the original trim position. Alternatively, a manually operable trim ratchet assembly allows the operator to temporarily tilt the engine to and have it held at a higher trim position if desired. Disengagement of the trim ratchet assembly also allows direct return of the motor to the original trim position.

U.S. Pat. No. 4,472,148, which issued to Kollock et al on Sep. 18, 1984, discloses a tilt mechanism for an outboard motor. The mechanism has a swivel bracket pivotally attached to a transom bracket. A trim pin is carried by a trim pin carrier which is pivotally attached to the swivel bracket. The trim pin travels in cam slots which define two connected cam loops and act as a ratchet with notches in the cam slots to establish trim and tilt positions for the propulsion unit. The two cam loops allow the propulsion unit to be returned to the uppermost position without dropping to the lowest position first. A moveable return cam in the lower loop allows the operator to select the lowest trim position to which the unit will return.

U.S. Pat. No. 5,855,496, which issued to Lokken on Jan. 5, 1999, discloses an overcenter uplock assembly for an outboard motor. The assembly for an outboard motor tilt mechanism has a pair of brackets pivotally connected with an overcenter hinge. The uplock assembly has a lever that an operator uses to force the brackets into an in-line, end-to-end overcenter configuration in which the lower bracket supports against a horizontal support axle attached to the trim mechanism and an upper bracket pushes against a swivel bracket of the tilt mechanism. The upper and lower brackets are sized so that the swivel bracket is pushed beyond its normal full up trailering position into a tight configuration in which the swivel bracket and motor are restrained from bouncing even under excessively rough transportation conditions. Preferably, the uplock assembly includes a lever guide member having a catch mechanism that secures the lever in a fixed position when the uplock assembly is engaged to support the outboard motor.

U.S. Pat. No. 4,331,430, which issued to Lutzke et al on May 25, 1982, discloses a trim mechanism with an automatic return. A tilt mechanism for a marine propulsion device is provided with a swivel bracket pivotally attached to a transom bracket. A trim pin is carried by a trim pin carrier which is pivotally attached to the swivel bracket. The trim pin travels in cam tracks on the transom bracket and engages notches in the cam tracks to establish trim and tilt positions for the propulsion device. An axially step in the cam track shifts the trim pin to a return cam surface to allow automatic return from the uppermost to the lowest position.

U.S. Pat. No. 4,925,410, which issued to Boda on May 15, 1990, discloses a tilt mechanism lock for an outboard motor. A conventional tilt mechanism for an outboard motor is provided with a series of trim position notches and an uppermost trailering position notch including a tilt position locking mechanism which is manually operable to lock the motor in the trailering position to positively prevent downward movement therefrom, either intentionally or inadvertently as a result of a shock load or jarring of the motor. The tilt locking mechanism is incorporated completely into one of the clamping members of a conventional tilt mechanism such that it does not interfere whatever with conventional operation of the tilt mechanism when in the unlocked position or with movement of the motor to the trailering position when in the locked position. However, downward movement of the motor when the mechanism is in the locked position is absolutely precluded.

The patents described above are hereby explicitly incorporated by reference in the description of the present invention.

It would be significantly beneficial if a device could be provided that supports an outboard motor in an upwardly tilted position and prevents rotation in either an upward or downward direction about its tilt access while also inhibiting rotation of the outboard motor about its steering access.

SUMMARY OF THE INVENTION

A support mechanism for an outboard motor made in accordance with a preferred embodiment of the present invention comprises a latching device that is rigidly attached to an outboard motor and, more specifically, to the driveshaft housing of the outboard motor. It also comprises a support arm which has a pivot portion and a latching portion. The pivot portion is attachable to a transom of a marine vessel, and more specifically, to a transom bracket of the outboard motor. The pivot portion is rotatable about an axis of rotation which is generally parallel to and in a fixed relationship with the transom of a marine vessel. Rotation of the pivot portion causes the latching portion to move in relation to the latching device which is attached to the outboard motor. The latching device is shaped to capture the latching portion of the support arm and to thereby inhibit movement of the latching portion relative to the latching device and also inhibit movement of the outboard motor relative to the transom.

In a particularly preferred embodiment of the present invention, the support arm comprises a rod which is shaped in a generally U-shaped configuration with a first distal end and a second distal end disposed to define an axis of rotation therebetween. The first and second distal ends combine to define the pivot portion of the support arm. The latching portion is generally disposed midway along the length of the rod between the first and distal ends of the support arm.

The latching portion of the support arm comprises a generally straight segment of the support arm and the latching device comprises an open slot shaped to receive the latching portion of the support arm therein. The latching device comprises a capture slot shaped to receive the latching portion in captive association therein, whereby the capture slot is proximate the open slot to allow the latching portion of the support arm to move between the open slot and the capture slot.

A preferred embodiment of the present invention further comprises a capture bar that is slidably disposed within the latching device and movable between an open position and a capture position. The latching portion is movable from the capture slot to the open slot when the capture bar is in the open position, but the latching position is inhibited from moving from the capture slot to the open slot when the capture bar is in the capture position. The capture bar is shaped to permit the latching portion to cause the capture bar to move from the capture position to the open position in response to a force exerted by the latching portion against the capture bar. A resilient member is provided, in a particularly preferred embodiment of the present invention, for urging the capture bar from the open position toward the capture position. This resilient member can be a spring. A handle is attached to the latching device in order to allow the capture bar to be forced, against the urging of the resilient member, toward the open position. This urging is accomplished manually by the operator of a marine vessel who moves the handle to move the capture bar from the capture position to the open position.

The support arm of the present invention is rotatable between a first position, wherein the support arm is generally disposed within a plane that is generally parallel to the transom of a marine vessel and a second position, wherein the latching portion is disposed within the latching device. The latching device is rigidly attached to a driveshaft housing of the outboard motor in a preferred embodiment and the support arm is rotatably attached to a transom bracket of the outboard motor in a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
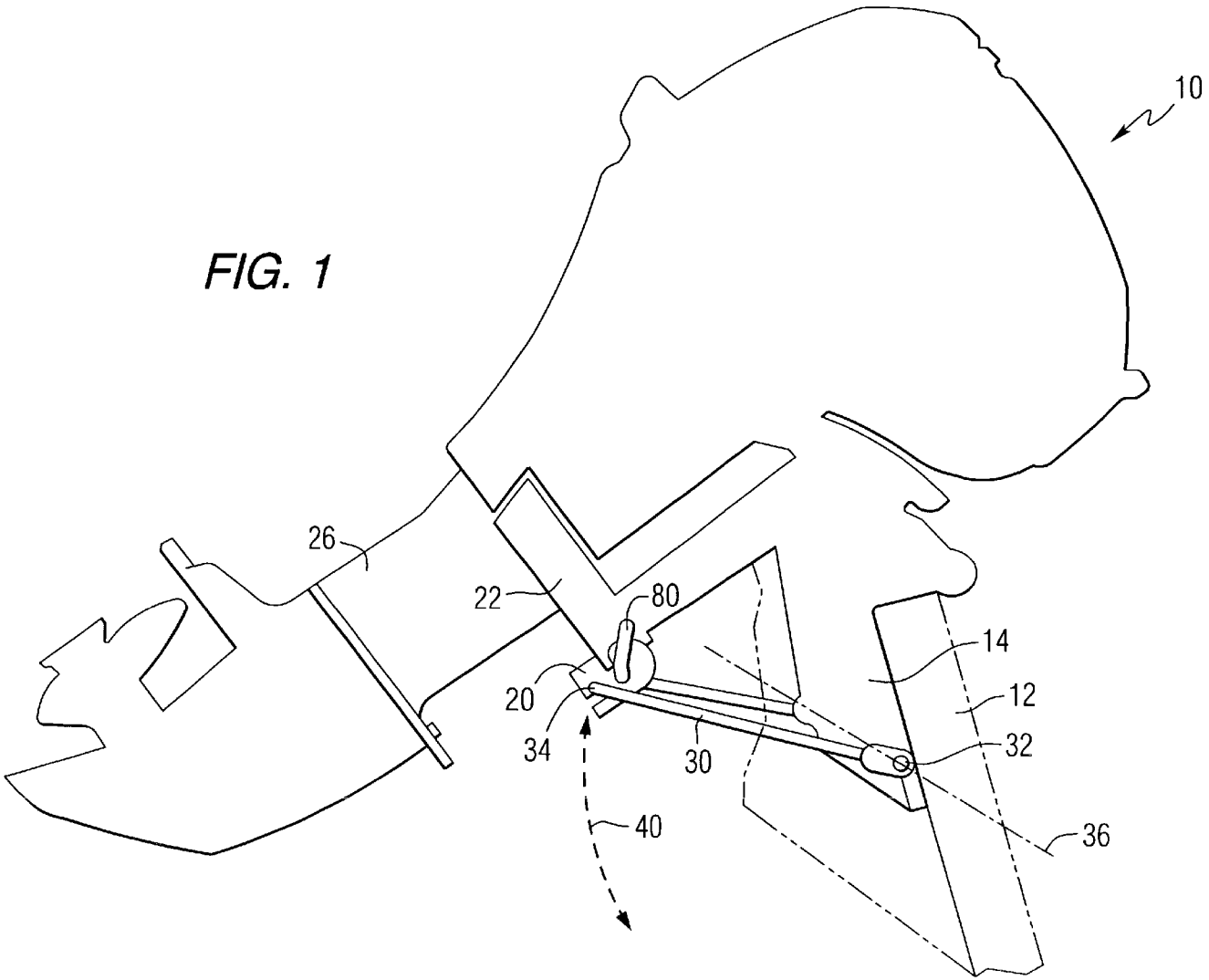
FIG. 1 is a simplified silhouette representation of an outboard motor supported by the present invention.

Throughout the description of the preferred embodiment of the present invention, like components will be identified by like reference numerals.

FIG. 1 is a highly simplified representation of an outboard motor 10 which is attached to a transom 12 of a marine vessel. The outboard motor 10 is shown in silhouette in order to simplify the illustration and to specifically illustrate the relationship of the present invention to the outboard motor. Typically, an outboard motor 10 is attached to the transom 12 by a transom bracket 14 which is also shown in silhouette and in an isometric representation in order to show the support arm of the present invention more clearly. A latching device 20 is attached to the outboard motor 10. The latching device 20 can be attached to a support structure 22 or, alternatively, to a driveshaft housing 26 of the outboard motor 10. A support arm 30 is provided with a pivot portion 32 and a latching portion 34. The pivot portion 32 is attachable to the transom 12 of a marine vessel and is rotatable, about an axis of rotation 36 which is generally parallel to and in fixed relationship with the transom 12. This rotation causes the latching portion 34 to move in relation to the latching device 20, as represented by dashed line arrow 40. The latching device 20, as will be described in greater detail below, is shaped to capture the latching portion 34 of the support arm 30 and thereby inhibit movement of the latching portion 34 relative to the latching device 20 and also to inhibit movement of the outboard motor 10 relative to the transom 12.

Figure 2:
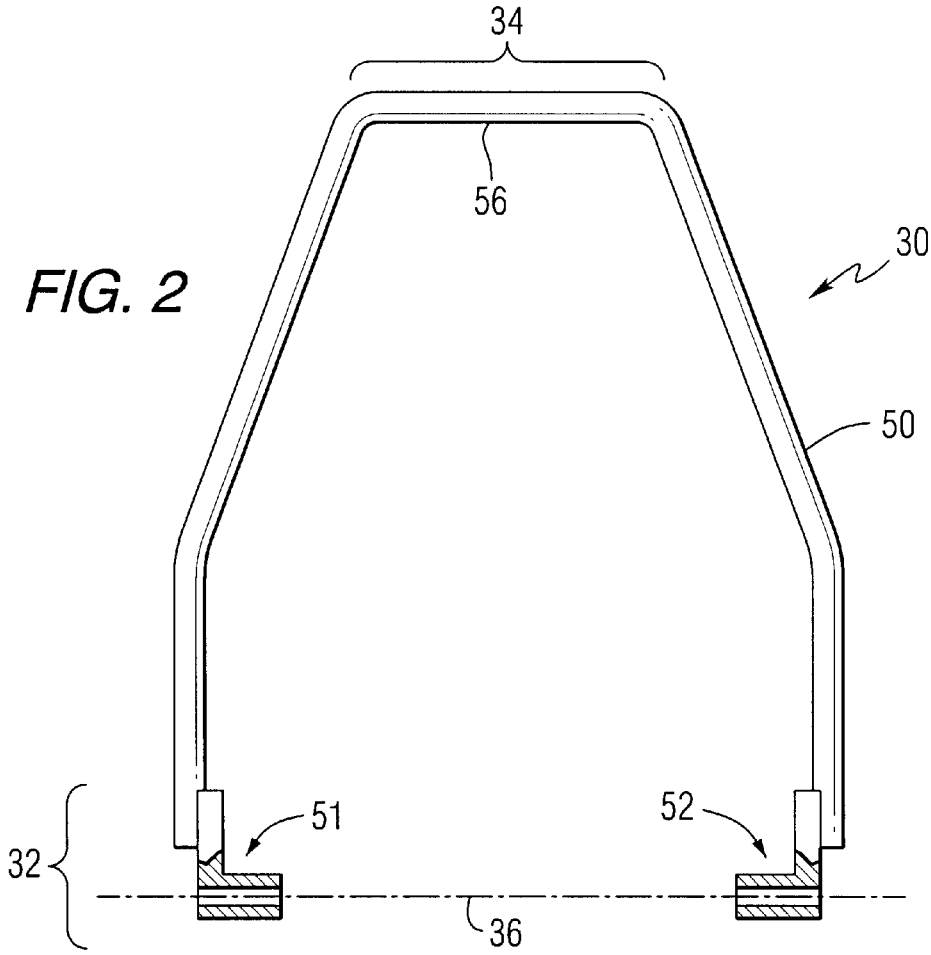
FIG. 2 shows the support arm of the present invention.

FIG. 2 illustrates the support arm 30 which, in a particularly preferred embodiment of the present invention, comprises a rod 50 that is shaped in a generally U-shaped configuration with a first distal end 51 and a second distal end 52. Although the first and second distal ends, 51 and 52, are shown as components that are attached to the rod 50 in FIG. 2, it should be understood that a preferred embodiment of the present invention could also shape the ends of the rod 50 to perform these functions. Throughout the description of the preferred embodiment of the present invention, it should be understood that the distal ends, 51 and 52, are to be considered portions of the rod 50. The first and second distal ends, 51 and 52, define the axis of rotation 36 between them. In doing so, the first and second distal ends combine to define the pivot portion 32 of the support arm.

The latching portion 34 of the support arm 30 is disposed generally midway between the first and second distal ends, 51 and 52, as measured along the length of the rod 50. The latching portion 34 comprises a generally straight segment 56 of the support arm 30.

Figure 3:
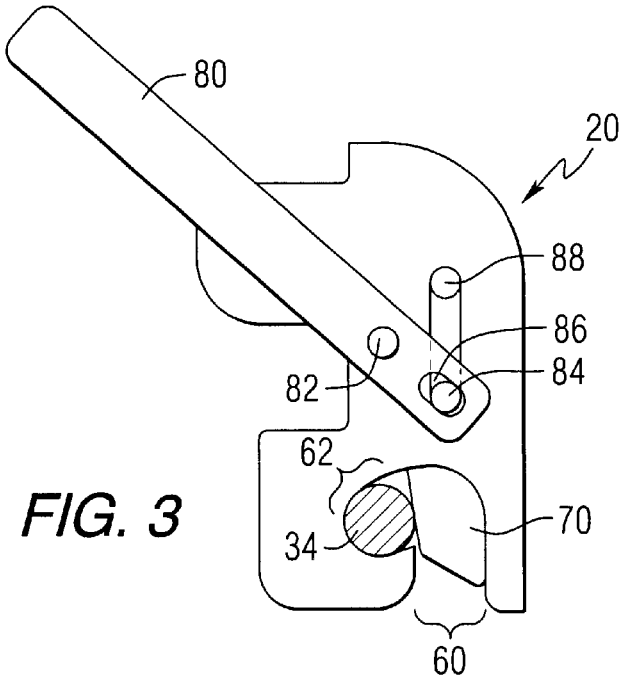
FIG. 3 shows the latching device of the present invention.

FIG. 3 is an isolated view of the latching device 20 of the present invention. The latching device comprises an open slot 60 that is shaped to receive the latching portion 34 of the support arm 30, as represented by the section view of the latching portion 34 in FIG. 3. The latching device 20 also comprises a capture slot 62 which is shaped to receive the latching portion 34 in captive association therein. The capture slot 62 is proximate the open slot 60 in order to allow the latching portion 34 of the support arm 30 to move between the open slot 60 and the capture slot 62. A capture bar 70 is slidably disposed within the latching device 20 and is movable between an open position and a capture position. The capture position is represented in FIG. 3 with the capture bar 70 disposed at its lowest position, blocking the capture slot 62. Although not specifically illustrated in FIG. 3, the capture bar 70 can be raised upwardly in order to open the capture slot 62 and allow the latching portion 34 to move from the capture slot 62 to the open slot 60 and be removed from the latching device 20. The latching portion 34 is movable from the capture slot 62 to the open slot 60 when the capture bar 70 is in the open position (upward in FIG. 3) and the latching portion 34 is inhibited from moving from the capture slot 62 to the open slot 60 when the capture bar 70 is in the capture position, as represented in FIG. 3.

With continued reference to FIG. 3, the capture bar 70 is shaped to permit the latching portion 34 to cause the capture bar 70 to move upward from the capture position shown in FIG. 3 to the open position, with the capture bar 70 moved upward within the body of the latching device 20, in response to a force exerted by the latching portion 34 against the capture bar 70, as will be described in greater detail below in conjunction with FIG. 4.

In FIG. 3, a handle 80 is used to assist the operator of the marine vessel to raise the capture bar 70 from the capture position to the open position. In the preferred embodiment, the handle 80 is a simple bar which pivots about an axis 82 and is linked to a pin 84 that is attached to the capture bar 70. By rotating the handle 80 counterclockwise about the pivot point 82, the pin 84 can be raised from the position shown within the slot 86 of the handle to the position identified by reference numeral 88 in FIG. 3.

Figure 4:
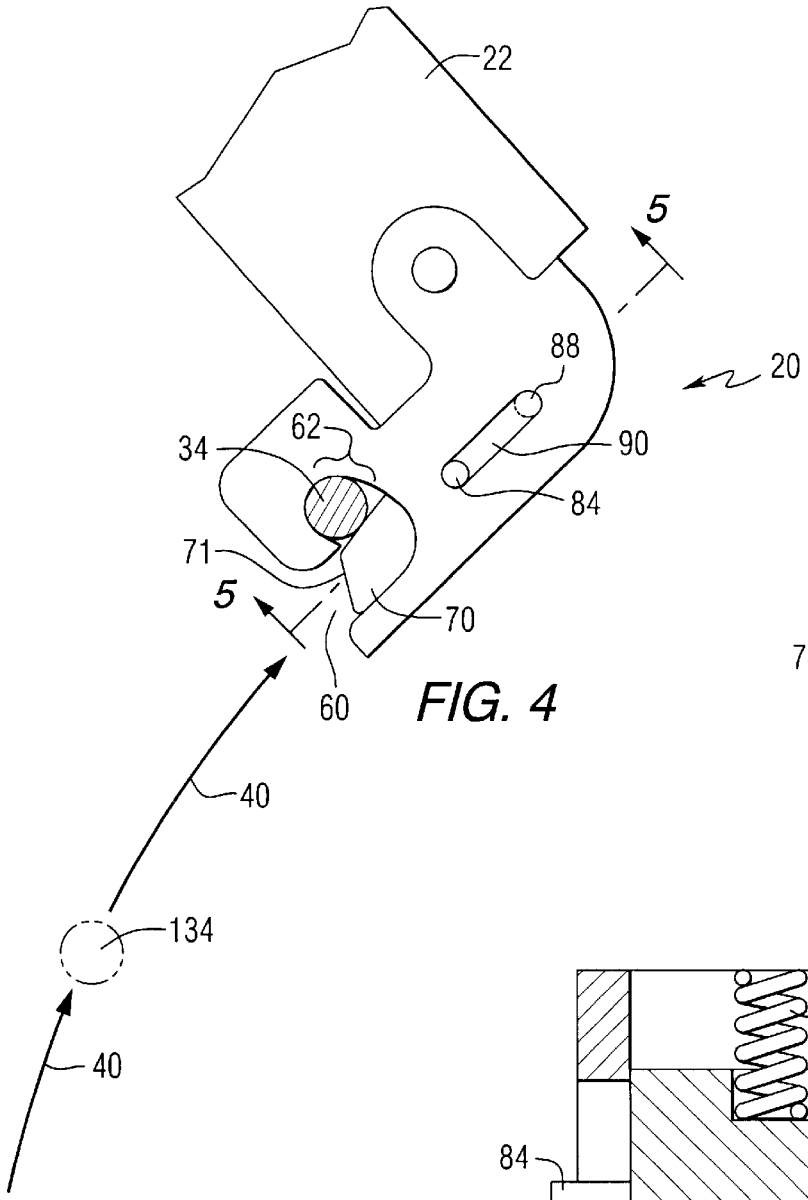
FIG. 4 shows the interrelationship between the support arm and the latching device of the present invention.

FIG. 4 shows the latching device 20 attached to the support member 22 described above in conjunction with FIG. 1. The handle 80 is not shown in FIG. 4 for purposes of clarity. With the capture bar 70 in the position shown in FIG. 4, and the pin 84 in the position shown relative to the slot 90, a latching portion 34 is captured within the capture slot 62. When an operator desires to achieve the relationship shown in FIG. 4 between the latching portion 34 of the support arm 30 and the latching device 20, the support arm is moved to rotate it about the axis of rotation 36 discussed in conjunction with FIG. 1. This rotation causes the latching portion 34 to move upward toward the latching device 20, as represented by the dashed line version of the latching portion 34 which is identified by reference numeral 134 in FIG. 4. The latching portion moves upward, as represented by arrows 40, until the latching portion of the support arm contacts the lower surface 71 of the capture bar 70. A force exerted against this lower surface 71 by the upwardly moving latching portion 34 pushes the capture bar 70 upward against the resistance of an internal spring, which will be described below in conjunction with FIG. 5, and moves the pin 84 to the position represented by reference numeral 88 in FIG. 4. This unblocks the capture slot 62 and allows the latching portion 34 to move through the open slot 60 and into the capture slot 62. Since the upward force against the lower portion 71 is then removed, the capture bar 70 moves to its position shown in FIG. 4 under the urging of the spring. This completes the capture of the latching portion 34 within the capture slot 62. In order to release the latching portion 34 from the capture slot 62, the operator must manually move the capture bar 70 upward, through the use of the handle 80, to cause the pin to move from position 84 to that identified by reference numeral 88 in FIG. 4.

It can be seen that the operation required to latch the outboard motor in place, by moving the latching portion 34 into the open slot 60 and then into the capture slot 62, is relatively simple and easily accomplished. It can also be seen that, once the latching portion 34 is captured within the capture slot 62, it will remain in place until the capture bar 70 is manually moved upward to release it. This locks the outboard motor 10 in position and prevents both upward and downward movement of the outboard motor which could otherwise result from a rotation of the outboard motor about its tilt axis.

Figure 5:
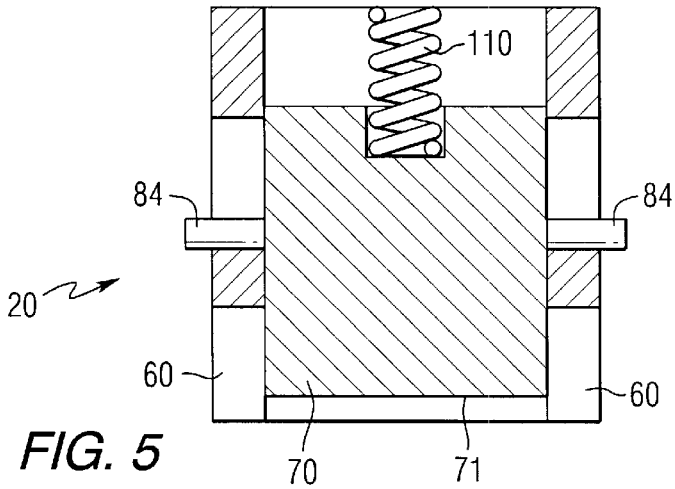
FIG. 5 is a section view of FIG. 4.

FIG. 5 is a section view of FIG. 4, as shown by the section arrows in FIG. 4 and shows the capture bar 70 disposed in sliding relation within the latching device 20. It also shows the pins 84 that allow the operator to manipulate the capture bar 70 by movement of the handle 80 described above. The resilient member is a spring 110 which urges the capture bar 70 downward to maintain it in a capture position relative to the open slot 60 and the capture slot 62. When moved upward against the resistance of the spring 110, the capture bar 70 moves to an open position relative to the capture slot 62. When moved downward to the position shown in FIG. 5, the capture bar 70 is in a capture position that prevents movement of the latching portion 34 out of the capture slot 62.

Figure 6:
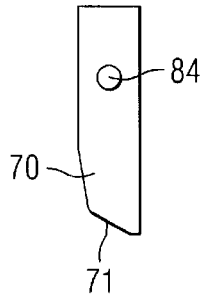
FIG. 6 is a representation of the capture bar of the present invention.

FIG. 6 shows the capture bar 70, with its pin 84 and its lower surface 71 that allows the capture bar 70 to be moved upward relative to the latching device in response to the latching portion 34 of the support arm 30 pushing upwardly against surface 71.

With reference to FIGS. 1–6, it can be seen that the latching device 20 of the present invention allows the outboard motor 10 to be held rigidly in position when the latching portion 34 of the support arm 30 is captured within the capture slots 62 of the latching device 20. When the latching portion 34 is captured within the latching device 20, the outboard motor 10 is prevented from further rotation about its tilt access, in either an upper or downward direction. Furthermore, the relative locations of the first and second distal ends, 51 and 52, are located relative to each other to provide a generally rigid base that also prevents rotation of the outboard motor 10 about its steering axis. By holding the outboard motor 10 in the position shown in FIG. 1, when the outboard motor is tilted upward for either transportation or temporary storage when not in use, the present invention significantly decreases the likelihood of damage to the outboard motor or, more particularly, to its support brackets and transom bracket, when the outboard motor is subjected to shock loads while in the upward position shown in FIG. 1. During transportation on a trailer or during high wave conditions in associated with a boat on the water, shock loads experienced by the marine vessel are transmitted to the outboard motor. Under normal conditions, without a support bracket such as that described in conjunction with the description of the preferred embodiment of the present invention, these shock loads can be sufficient to stress the support brackets of the outboard motor 10 and, eventually, fracture the brackets. When this occurs, the outboard motor 10 can be disconnected from its support brackets and from the transom of the marine vessel. If this occurs, the outboard motor can fall from the marine vessel and be lost under significant depths of water in a lake or ocean.

Although the present invention has been described in particular detail and illustrated to show one preferred embodiment, it should be understood that alternative embodiments are also within its scope.

I claim:

1. A support mechanism for an outboard motor, comprising:

a latching device attached to said outboard motor;

a support arm having a pivot portion and a latching portion, said pivot portion being attachable to a transom of a marine vessel, said pivot portion being rotatable, about an axis of rotation which is generally parallel to and in a fixed relationship with said transom, to cause said latching portion to move in relation to said latching device, said latching device being shaped to capture said latching portion of said support arm and to thereby inhibit movement of said latching portion relative to said latching device and inhibit movement of said outboard motor relative to said transom; and a capture bar movable relative to said latching device for retaining said latching portion relative to said latching device when said capture bar is in a capture position.

2. The support mechanism of claim 1, wherein:

said support arm comprises a rod which is shaped in a generally U-shaped configuration with a first distal end and a second distal end disposed to define said axis of rotation therebetween, said first and second distal ends combining to define said pivot portion.

3. The support mechanism of claim 2, wherein:

said latching portion is disposed generally midway between said first and second distal ends of said support arm along the length of said rod.

4. The support mechanism of claim 1, wherein:

said latching portion comprises a generally straight segment of said support arm.

5. The support mechanism of claim 1, wherein:

said latching device comprises an open slot shaped to receive said latching portion of said support arm therein.

6. The support mechanism of claim 5, wherein:

said latching device comprises a capture slot shaped to receive said latching portion in captive association therein, said capture slot being proximate said open slot to allow said latching portion of said support arm to move between said open slot and capture slot.

7. The support mechanism of claim 6, wherein:

said capture bar is slidably disposed within said latching device and movable between an open position and said capture position, said latching portion being movable from said capture slot to said open slot when said capture bar is in said open position, said latching portion being inhibited from moving from said capture slot to said open slot when said capture bar is in said capture position.

8. The support mechanism of claim 7, wherein:

said capture bar is shaped to permit said latching portion to cause said capture bar to move from said capture position to said open position in response to a force exerted by said latching portion against said capture bar.

9. The support mechanism of claim 8, further comprising:

a resilient member for urging said capture bar from said open position toward said capture position.

10. The support mechanism of claim 6, further comprising:

a handle attached to said latching device to allow said capture bar to be forced, against the urging of said resilient member, toward said open position.

11. The support mechanism of claim 10, wherein:

said support arm is rotatable between a first position wherein said support arm is generally disposed within a plane that is generally parallel to said transom and a second position wherein said latching portion is disposed within said latching device.

12. The support mechanism of claim 11, wherein:

said latching device is rigidly attached to a drive shaft housing of said outboard motor.

13. A support mechanism for an outboard motor, comprising:

a latching device attached to said outboard motor;

a support arm having a pivot portion and a latching portion, said pivot portion being attachable to a transom of a marine vessel, said pivot portion being rotatable, about an axis of rotation which is generally parallel to and in a fixed relationship with said transom, to cause said latching portion to move in relation to said latching device, said latching device being shaped to capture said latching portion of said support arm and to thereby inhibit movement of said latching portion relative to said latching device and inhibit movement of said outboard motor relative to said transom, said support arm comprising a rod which is shaped in a generally U-shaped configuration with a first distal end and a second distal end disposed to define said axis of rotation therebetween, said first and second distal ends combining to define said pivot portion, said latching portion being disposed generally midway between said first and second distal ends of said support arm along the length of said rod; and a capture bar movable relative to said latching device for retaining said latching portion relative to said latching device when said capture bar is in a capture position.

14. The support mechanism of claim 13, wherein:

said latching device comprises an open slot and a capture slot, said open slot being shaped to receive said latching portion of said support arm therein and said capture slot being shaped to receive said latching portion in captive association therein, said capture slot being proximate said open slot to allow said latching portion of said support arm to move between said open slot and capture slot.

15. The support mechanism of claim 14, wherein:

said capture bar is slidably disposed within said latching device and movable between an open position and said capture position, said latching portion being movable from said capture slot to said open slot when said capture bar is in said open position, said latching portion being inhibited from moving from said capture slot to said open slot when said capture bar is in said capture position, said capture bar being shaped to permit said latching portion to cause said capture bar to move from said capture position to said open position in response to a force exerted by said latching portion against said capture bar.

16. The support mechanism of claim 15, further comprising:

a resilient member for urging said capture bar from said open position toward said capture position.

17. The support mechanism of claim 16, further comprising:

a handle attached to said latching device to allow said capture bar to be forced, against the urging of said resilient member, toward said open position.

18. The support mechanism of claim 17, wherein:

said support arm is rotatable between a first position wherein said support arm is generally disposed within a plane that is generally parallel to said transom and a second position wherein said latching portion is disposed within said latching device.

19. A support mechanism for an outboard motor, comprising:

a latching device attached to said outboard motor;

a support arm having a pivot portion and a latching portion, said pivot portion being attachable to a transom of a marine vessel, said pivot portion being rotatable, about an axis of rotation which is generally parallel to and in a fixed relationship with said transom, to cause said latching portion to move in relation to said latching device, said latching device being shaped to capture said latching portion of said support arm and to thereby inhibit movement of said latching portion relative to said latching device and inhibit movement of said outboard motor relative to said transom, said support arm comprising a rod which is shaped in a generally U-shaped configuration with a first distal end and a second distal end disposed to define said axis of rotation therebetween, said first and second distal ends combining to define said pivot portion, said latching portion being disposed generally midway between said first and second distal ends of said support arm along the length of said rod;

a capture bar slidably disposed within said latching device and movable between an open position and a capture position, said latching portion being movable from said capture slot to said open slot when said capture bar is in said open position, said latching portion being inhibited from moving from said capture slot to said open slot when said capture bar is in said capture position, said capture bar being shaped to permit said latching portion to cause said capture bar to move from said capture position to said open position in response to a force exerted by said latching portion against said capture bar;

a resilient member for urging said capture bar from said open position toward said capture position; and a handle attached to said latching device to allow said capture bar to be forced, against the urging of said resilient member, toward said open position, said latching device comprising an open slot and a capture slot, said open slot being shaped to receive said latching portion of said support arm therein and said capture slot being shaped to receive said latching portion in captive association therein, said capture slot being proximate said open slot to allow said latching portion of said support arm to move between said open slot and capture slot.

20. The support mechanism of claim 19, wherein:

said support arm is rotatable between a first position wherein said support arm is generally disposed within a plane that is generally parallel to said transom and a second position wherein said latching portion is disposed within said latching device and said latching portion comprises a generally straight segment of said support arm.

* * * * *